US008147317B2

(12) United States Patent
Plowman

(10) Patent No.: US 8,147,317 B2
(45) Date of Patent: Apr. 3, 2012

(54) GAMING SYSTEM AND METHOD WITH WAGER VARIABILITY

(75) Inventor: Gregory Leigh Plowman, Alexandria (AU)

(73) Assignee: Aristocrat Technologies Australia Pty Ltd (AU)

( * ) Notice: Subject to any disclaimer, the term of this patent is extended or adjusted under 35 U.S.C. 154(b) by 1219 days.

(21) Appl. No.: 11/865,399

(22) Filed: Oct. 1, 2007

(65) Prior Publication Data

US 2008/0081688 A1 Apr. 3, 2008

(30) Foreign Application Priority Data

Sep. 29, 2006 (AU) ..... 2006905408

(51) Int. Cl.
*A63F 9/24* (2006.01)

(52) U.S. Cl. ..... 463/21

(58) Field of Classification Search ..... 463/21
See application file for complete search history.

(56) References Cited

FOREIGN PATENT DOCUMENTS

WO WO 2005/086018 9/2005

OTHER PUBLICATIONS

Examiner's first report corresponding to Australian Patent Application Serial No. 2007221772, dated Mar. 16, 2009.

*Primary Examiner* — Corbett B Coburn
(74) *Attorney, Agent, or Firm* — McAndrews, Held & Malloy, Ltd.

(57) ABSTRACT

A gaming machine that provides a wagering game, including a user interface in communication with a game controller, through the operation of which a player selects one of a plurality of wager options that determine a number of symbols to be active and inactive in the wagering game. For at least one said wager option at least one, but not all of the plurality of symbols that define a possible said winning combination are rendered inactive for forming the winning combination.

6 Claims, 4 Drawing Sheets

GAMING SYSTEM AND METHOD WITH WAGER VARIABILITY

CROSS REFERENCE TO RELATED APPLICATIONS

This application claims priority to Australian Patent Application No. 2006905408, having a filing date of Sep. 29, 2006, entitled "Gaming System and Method With Wager Variability", which is hereby incorporated by reference herein in its entirety.

FIELD OF THE INVENTION

The present invention generally relates to gaming apparatus and methods of gaming. A particular embodiment of the present invention relates to gaming machines on which a player may selectively place wagers on one or more game outcomes.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety, while still developing games that comply with the relevant regulations in the jurisdiction of the gaming venue operator. Suppliers of gaming devices therefore are faced with restrictions on the types of games and gaming apparatus that are allowable, both in terms of the prevailing regulations and in terms of providing a return on investment to the gaming venue operators.

In some jurisdictions at present the regulations impose limits on the number or value of bets that can be placed on a game. This raises a problem of how to provide entertainment to players in a similar manner to the entertainment achieved through play of games that do not comply with the regulations. Even where the regulations do not have such a limitation, there is an ongoing need for alternative methods for players to place wagers in a wagering game on a gaming machine.

In addition, it is important that a player be able to understand the operation of a game quickly so that the player can start to quickly play the game and therefore extract maximum entertainment from the game.

SUMMARY OF THE INVENTION

According to a first aspect of the invention, there is provided a method of providing a wagering game on a gaming machine, the wagering game including a plurality of symbols that are displayed on a display to represent at least one outcome of the game, the plurality of symbols including a plurality of symbol classes, wherein a winning combination in the wagering game is represented as an occurrence of a combination of a plurality of symbols in the same class, the wagering game including a plurality of different winning combinations within two or more of the symbol classes, the method including:

determining which one of a plurality of available wager options has been placed in a game play of the wagering game;

forming at least one outcome from the plurality of symbols by displaying a symbol in each of a plurality of symbol display positions; and awarding an award according to a pay table of the gaming machine if a winning combination occurs;

wherein the method further includes, for at least one wager option, defining at least one, but less than all of the symbols in at least two different symbol classes as inactive for forming a winning combination.

In one embodiment, at least one said winning combination is available for each and every one of the plurality of symbol classes irrespective of the wager option that is placed.

In one embodiment, for at least one of the wager options all or substantially all of the symbol classes have at least one symbol that is defined as inactive for forming a said winning combination.

In one embodiment, for at least one wager option, the symbols that are rendered inactive have the effect of approximately at least one third of the symbols being defined as inactive for forming a said winning combination.

In one embodiment, the wagering game is a spinning reel game having a plurality of reels, each reel having a plurality of symbols that are each located in a symbol position on the reel, wherein forming at least one outcome includes determining the stopping position of the reels to display symbols on the reels in the symbol display positions, and wherein on at least one of the reels symbols from at least two different symbol classes are defined as inactive.

According to a second aspect of the present invention, there is provided a method of providing a wagering game on a gaming machine, the wagering game including presenting symbols on a display according to a random selection process, the method including:

determining which one of a plurality of wager options has been placed in a game play of the wagering game;

rendering at least one symbol that is available to be selected for presentation o the display inactive, the number of symbols rendered inactive depending on the wager option that has been placed;

forming at least one outcome from a plurality of symbols, the number of outcomes formed being fixed regardless of the said wager option that is placed; and awarding an award if a winning combination of symbols occurs in a said outcome formed by active symbols in the formed at least one outcome and not awarding an award for the combination if one or more the symbols are inactive.

In one embodiment, the wagering game is a spinning reel game and wherein the outcomes are defined across an array of symbols presented by the spinning reels, and wherein the number of outcomes is equal to $n^m$, wherein n is the number of rows in the array and m is the number of columns in the array. In this embodiment, for at least one wager option, the number of inactive symbols is selected so that the effective number of outcomes for every game play played at that wager option, the number of outcomes is effectively less than $n^m$.

According to a third aspect of the invention, there is provided a method of providing a wagering game on a gaming machine, the wagering game including presenting a plurality of symbols on a display to form one or more outcomes, which are evaluated for a winning outcome, the method including:

determining which one of a plurality of wager options has been placed in a game play of the wagering game;

selecting at least one symbol dependent on the wager option that has been placed and rendering each selected symbol inactive for forming a winning outcome, wherein at least two different classes or types of symbol are rendered inactive for a single wager option;

selecting in a random selection process symbols for display in symbol display positions to form the one or more outcomes, the selection made from a combined set including both active and the inactive symbols, whereby whether a symbol display position displays an active or inactive symbol is randomly determined;

paying an award for winning outcomes that occur which are defined by symbols that are active and not any symbols that have been rendered inactive.

In one embodiment, the selection of symbols to be rendered inactive is random or includes a random component.

In one embodiment, the process of selecting at least one symbol includes selecting a different number symbols for different wager options placed in the wagering game.

In one embodiment, the process of selecting at least one symbol is constrained so that every possible winning outcome remains achievable in the wagering game for every possible selection of symbols to be rendered inactive.

In one embodiment, the process of selecting symbols for display includes randomly determining the stopping position of a reel including a plurality of symbol positions, with at least one symbol position indicating an active symbol position and at least one other symbol position indicating an inactive symbol position.

According to a fourth aspect of the invention, there is provided a method of providing a spinning reel wagering game on a gaming machine, the wagering game including presenting on a display of the gaming machine a plurality of symbol positions on reels on a display to represent as symbols one or more outcomes of the game method including:

determining which one of a plurality of wager options has been placed in a game play of the wagering game;

rendering the symbols in a variable number of symbol positions inactive for forming a winning outcome, the number of symbol positions in which a symbol is made inactive being dependent on the wager option that was placed;

during game play presenting the reels so that the inactive and active symbols are distinguishable to the eye of a player of the gaming machine;

playing the wagering game and not paying an award for winning outcomes that occur which are defined by one or more symbols that have been rendered inactive.

In one embodiment, the plurality of symbol positions presented on the display form an array having m rows and n columns, and wherein the number of outcomes of the game is $n^m$. In this embodiment, the number of outcomes of the game may be fixed at $n^m$.

In one embodiment, at least one of the symbols that are rendered inactive is an ordinary game symbol, not a bonus symbol or special symbol.

In one embodiment, a plurality of the symbols that are rendered inactive are ordinary game symbols, not a bonus symbol or special symbol.

According to a fifth aspect of the present invention, there is provided a gaming system including or consisting of a gaming machine that provides a wagering game in which a plurality of symbols are presented on a display to represent one or more outcomes, play of the wagering game being controlled by a game controller in communication with the display, the gaming machine including a user interface in communication with the game controller, through the operation of which a player selects one of a plurality of wager options that determine a number of symbols to be active and inactive in the wagering game, wherein for at least one said wager option at least one, but not all of the plurality of symbols that define a possible said winning combination are rendered inactive for forming the winning combination and wherein for at least one said wager option the symbols presented on the display to represent one or more outcomes always includes at least one inactive symbol.

In one embodiment, for a said wager option in which the symbols presented on the display to represent one or more outcomes always include at least one inactive symbol, at least one symbol from substantially every possible winning combination is inactive and wherein the number of inactive symbols decreases as wager options having higher values are selected.

In one embodiment, the user interface and game controller are adapted to allow the player to select another wager option, which includes at least one of:

a) selection of the number of outcomes purchased, wherein an award is paid if a winning combination occurs in the purchased outcomes but not the outcomes that have not been purchased; and b) selection of an amount to wager on each outcome;

which is made independently of the selection of the number of inactive symbols.

In one embodiment, the wagering game is a spinning reel game including a plurality of reels each including a plurality of reel positions that carry a said symbol and wherein the game controller randomly selects the stopping position of the reel to display the symbols in a portion of the reel positions so as to display an array of symbols, across which a plurality of pay lines are defined that indicate the plurality of possible outcomes, wherein the symbols that are rendered inactive are defined by their position on the reels. In this embodiment, on at least one reel the inactive symbols may be distributed along the reel so that the ratio of active and inactive symbols that are displayed randomly varies as a result of the random selection of the stopping position of that reel.

In one embodiment, sufficient active symbols to form a winning combination are always presented on the display for every game play regardless of which wager option is selected.

Further aspects of the present invention and further embodiments of the aspects described in the preceding paragraphs will become apparent from the following description, given by way of example only and with reference to the accompanying drawings.

BRIEF DESCRIPTION OF THE DRAWINGS

The present invention will now be described, by way of example only, with reference to the accompanying drawings, in which.

DETAILED DESCRIPTION

Figure 1:
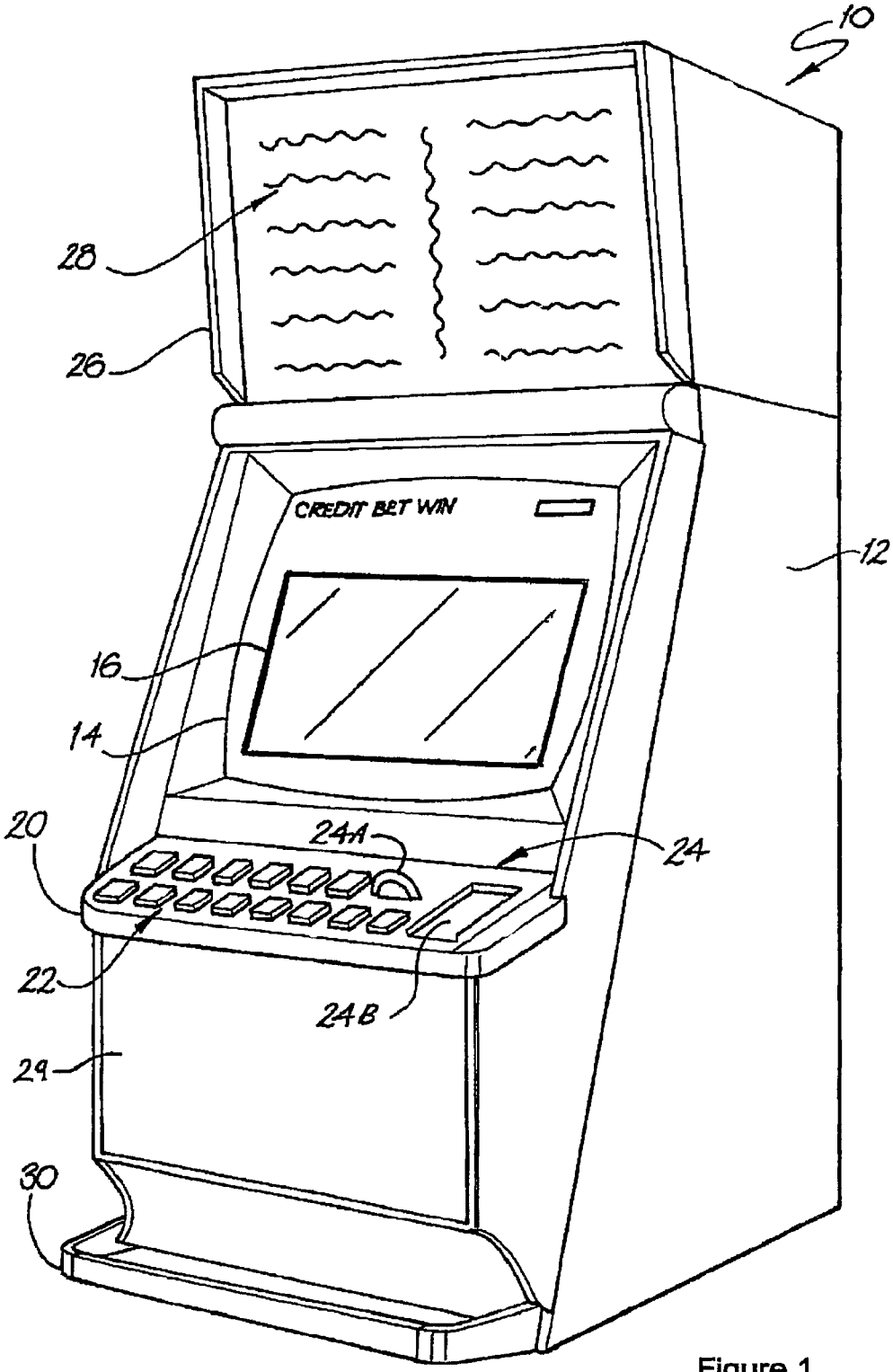
FIG. 1: shows diagrammatically, a view of a gaming machine suitable for implementing certain embodiments of the present invention.

In FIG. 1 of the accompanying drawings, one example of a gaming machine suitable for implementing certain embodiments of the present invention is generally referenced by arrow 10.

The gaming machine 10 includes a console 12 having a display 14 on which is displayed representations of a game 16, that can be played by a player. A mid-trim 20 of the gaming machine 10 houses a bank of buttons 22 for enabling a player to play the game 16. The mid-trim 20 also houses a credit input mechanism 24 including a coin input chute 24A and a bill collector 24B. A top box 26 may carry artwork 28, including for example, pay tables and details of bonus awards and other information or images relating to the game. Further artwork and/or information may be provided on the front panel 29 of the console 12. A coin tray 30 is mounted beneath the console 12 for cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or a different type of display.

Figure 2:
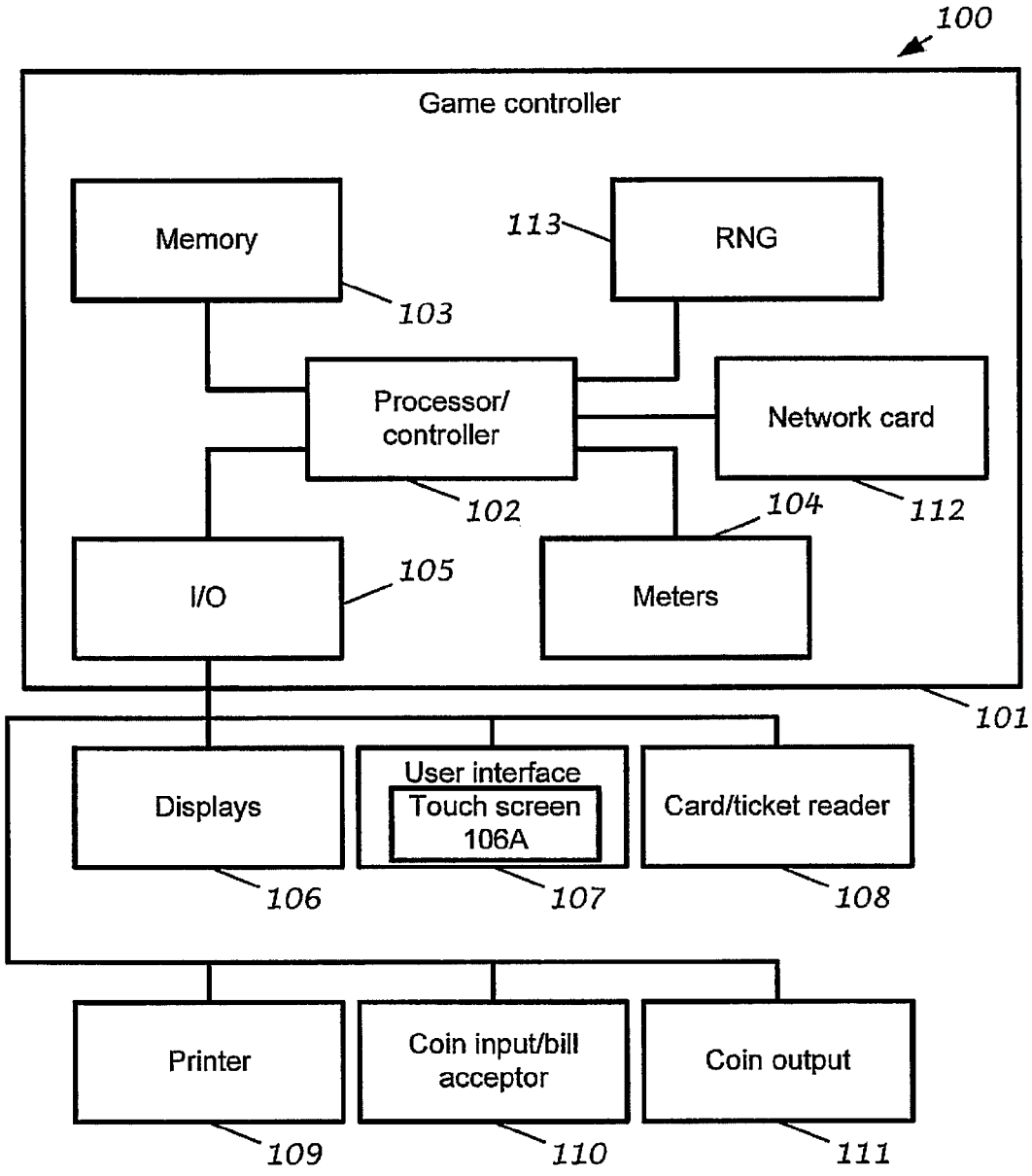
FIG. 2: shows a block diagram of gaming apparatus suitable for implementing certain embodiments of the present invention.

FIG. 2 shows a block diagram of a gaming apparatus, generally referenced by arrow 100, suitable for implementing certain embodiments of the present invention. The gaming apparatus 100 may, for example, operate as a standalone gaming machine of the type shown in FIG. 1. However, the gaming apparatus 100 may alternatively operate as a networked gaming machine, communicating with other network devices, such as one or more servers or other gaming machines. The gaming apparatus 100 may also have distributed hardware and software components that communicate with each other directly or through a network. Accordingly, different reference numerals have been used in FIG. 2 from FIG. 1 for components that may be equivalent.

The gaming apparatus 100 includes a game controller 101, which in the illustrated example includes a computational device 102, which may be a microprocessor, microcontroller, programmable logic device or other suitable device. Instructions and data to control operation of the computational device 102 are stored in a memory 103, which is in data communication with or forms a part of the computational device 102. Typically, the gaming apparatus 100 will include both volatile and non-volatile memory and more than one of each type of memory, with such memories being collectively represented by the memory 103. The instructions to cause the game controller 101 to implement the present invention will be stored in the memory 103.

The gaming apparatus may include hardware meters 104 for the purposes of regulatory compliance and also include an input/output (I/O) interface 105 for communicating with the peripheral devices of the gaming apparatus 100. The input/output interface 105 and/or the peripheral devices may be intelligent devices with their own memory for instructions and data.

In the example shown in FIG. 2, the peripheral devices that communicate with the controller are one or more displays 106, user input devices 107, a card and/or ticket reader 108, a printer 109, a bill acceptor and/or coin input mechanism 110 and a coin output mechanism 111. One or more of the displays 106 may include a touch screen 106A, forming part of the user input devices 107. Additional devices may be included as part of the gaming machine 100, or devices omitted as required for the specific implementation.

In addition, the gaming machine 100 may include a communications interface, for example a network card 112. The network card, may for example, send status information, accounting information or other information to a central controller, server or database and receive data or commands from a the central controller, server or database. One or more of the peripheral devices, for example the card/ticket reader 108 may be able to communicate directly with the network card 112.

The game controller 101 may also include a random number generator 113, which generates a series of random numbers that determine the outcome of a series of random game events played as part of a game on the gaming apparatus 100. As explained in more detail in relation to FIG. 4, the computational device 102 may include two or more controllers or processors, which may be local or remote from each other and the displays 106.

Figure 3:
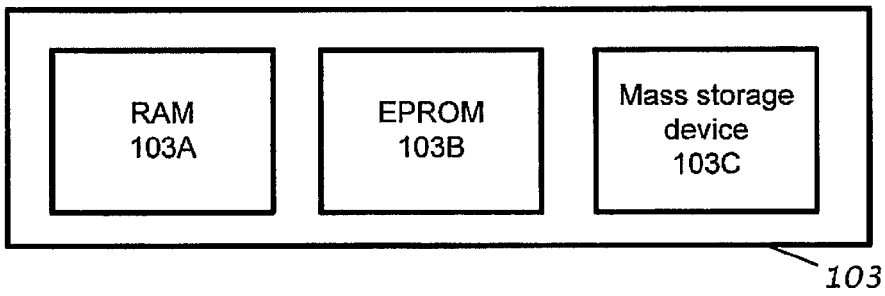
FIG. 3: shows a block diagram of components of the memory of the gaming apparatus represented in FIG. 2.

FIG. 3 shows an exemplary block diagram of the main components of the memory 103. The RAM 103A typically temporarily holds program files for execution by the computational controller 102 and related data. The EPROM 103B may hold be a boot ROM device and/or may contain some system or game related code. The mass storage device 103C is typically used to store game programs, the integrity of which may be verified and/or authenticated by the computational controller 102 using protected code from the EPROM 103B or elsewhere.

Figure 4:
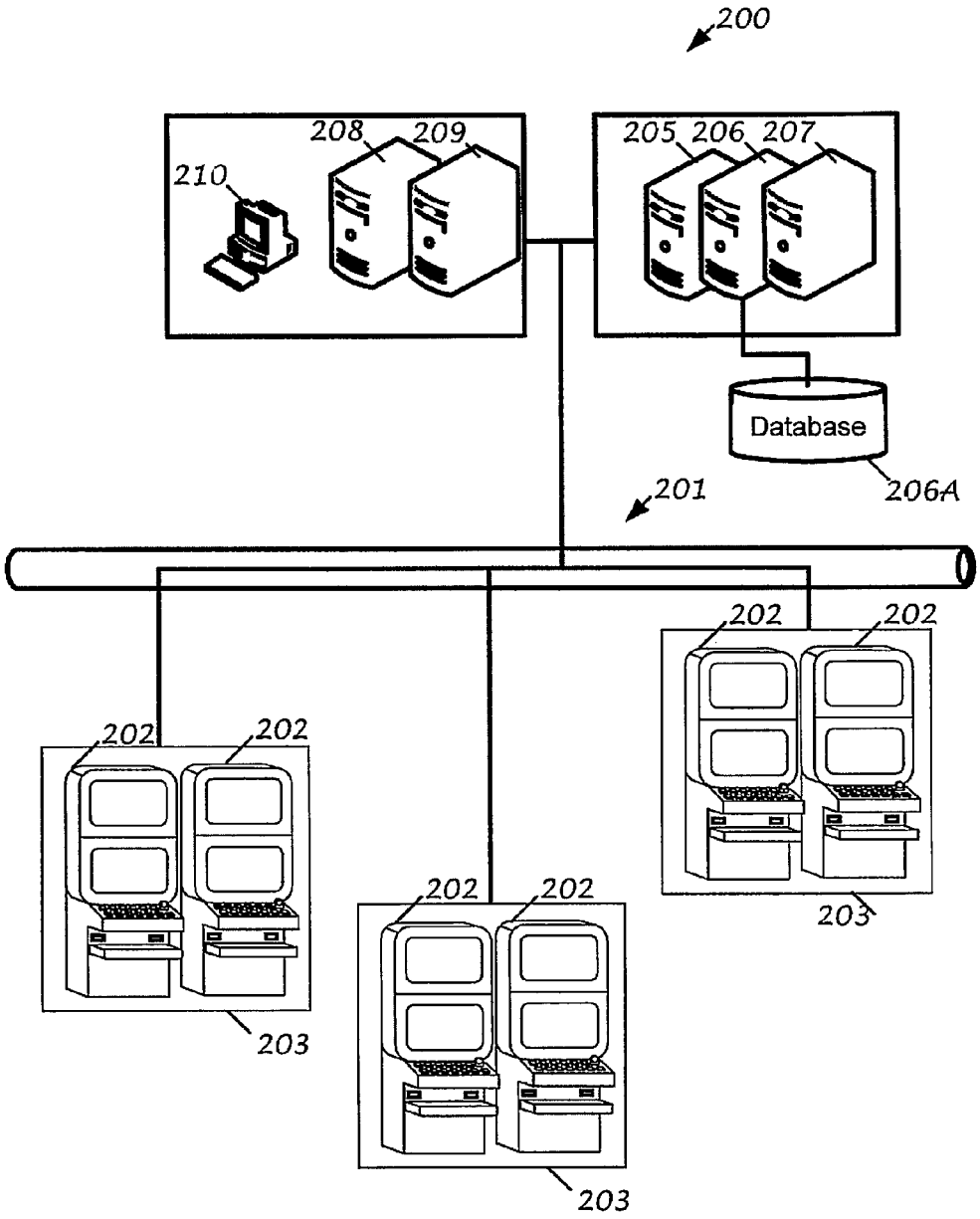
FIG. 4: shows diagrammatically, a network gaming system suitable for implementing certain embodiments of the present invention.

FIG. 4 shows a gaming system 200. The gaming system 200 includes a network 201, which for example may be an Ethernet network. Gaming devices 202, shown arranged in three banks 203 of two gaming devices 202 in FIG. 4, are connected to the network 201. The gaming devices 202 may be gaming machines 10, as shown in FIG. 1 or form part or all of another gaming apparatus 100. Single gaming devices 202 and banks 203 containing three or more gaming devices 202 may also be connected to the network 201.

Servers may also be connected to the network 201. For example, a game server 205 may generate game outcomes for games played on the gaming devices 202, a database management server 206 may manage the storage of game programs and associated data for downloading or access by the gaming devices 202 in a database 206A, and a jackpot server 207 may control one or more jackpots associated with the gaming devices 202.

Further servers may be provided to assist in the administration of the gaming system 200, including for example a gaming floor management server 208, and a licensing server 209 to monitor the use of licenses to particular games. An administrator terminal 210 is provided to allow an administrator to run the network 201 and the devices connected to the network.

Figure 5:
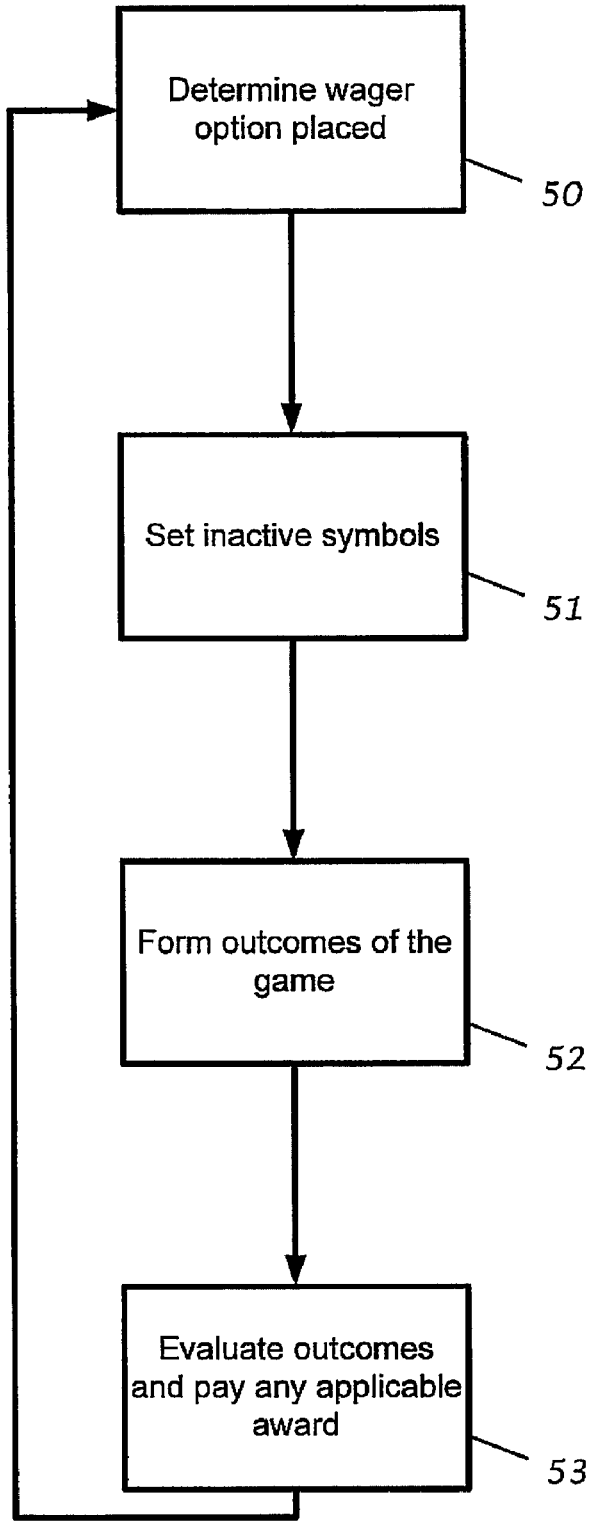
FIG. 5: shows a flow diagram of a process performed in accordance with certain embodiments of the present invention.

FIG. 5 shows a simple process flow diagram of a process performed in accordance with certain embodiments of the present invention. The process may be performed within the network gaming system 200, in which the gaming devices 202 may each include part or all of a gaming apparatus 100 and the following description assumes this implementation. However, those skilled in the relevant arts will appreciate that the process will also be able to be implemented by other gaming systems.

In step 50, the game controller 101 monitors operation of the user interface 107 for the selection of a wager option. This may occur in the usual manner, for example in a spinning reel game by a player selecting a number of pay lines and the wager per pay line and in a card game by a player selecting a number of hands to play.

Once the game controller 101 has determined which wager option has been placed, it then sets a number of symbols to be inactive (step 51). In a spinning reel game, for the leftmost reel, the number of inactive symbols for a particular wager option may be anywhere from zero up to all but one of the symbols. However, it is anticipated that in many practical implementations of a spinning reel game that displays three symbol positions for forming game outcomes, a maximum percentage of inactive symbols for a wager option would be between about 50% to 75% so that all or at least most spins of the real result in the formation of at least on outcome. The number of wager symbols rendered inactive may be dependent on the number of outcomes purchased and/or the size of the wager placed disregarding the bet per outcome.

Taking as an example a spinning reel game that has five reels and presents 3 symbols for each reel. In this game the maximum number of outcomes is typically 243, representing every combination of presented symbols when one presented symbol is taken from each reel. This mode of operation is sometimes called "243 Ways". If for regulatory or other reasons, the number of outcomes playable in a game was required to be limited, but the game designer wanted to provide the entertainment appeal of "243 Ways" as a bet option, then the game designer could design the game so that when this option is played, a proportion of the symbols on the reels are inactive.

For example, in the previously described spinning reel game that pays left to right, then if every symbol in every second symbol position on the left-most reel is rendered inactive, then the number of outcomes formed by active symbols is immediately halved on average, assuming equal probability of stopping positions. This occurs because, depending on where the inactive position stops in the window, there are either 81 possible pay lines defined by the active positions and 162 possible pay lines defined by the inactive positions, or vice-versa.

Other average numbers of outcomes can be achieved by varying proportion of inactive symbol positions on the first reel and on the other reels. If required a constant number of outcomes can be achieved for example, by rendering every third symbol on one or more of the reels inactive, so that one inactive symbol is always one and only one of the presented symbols for each reel that has inactive symbols.

Therefore, in this example, although the player may get a similar entertainment value to playing a full "243 Ways" game, the number of active outcomes can be limited. This can also keep the maximum wager size per game play lower than if full "243 Ways" was available. However, the player may still be able to specify a bet per outcome that acts to multiply the winnings that are paid on the occurrence of a winning outcome and/or place an ante-bet to result in eligibility for an additional game feature, maintaining a large number of options for the game designer to design varying games.

Taking again the 3 by 5 spinning reel game, instead of limiting the number of outcomes in a maximum bet, the game designer may require that a fully functional "243 Ways" option is available. However, the game designer may not want ordinary pay line play for lesser bet options. Therefore, the game designer may create a game in which the game controller 101 causes the number of inactive symbol positions to decrease with an increase in wager size.

In this second example, the game designer may still allow the player to purchase a number of outcomes and purchase a wager per outcome as is usual for many spinning reel games. A third bet option may then be provided that varies the number of inactive symbols. The bet options may be multiplied together to form the total wager for the game play, or otherwise combined depending on the particular game rules and the payout tables that are used. Alternatively, the number of outcomes and/or the wager per outcome may be fixed, reducing the number of wager options available to the player. The game designer may also include an ante-bet option if required, which operates independently of the number of inactive symbols.

Following the determination of the inactive symbols, the outcomes are then formed (step 52), which in a spinning reel game involves showing representations of the reels spinning and randomly selecting the stopping position of each reel. The outcomes are then defined by the symbols in each pay line that has been purchased. Each outcome is then evaluated for a winning outcome (step 53) and the award applicable to any occurring winning outcomes paid. The process then returns to step 50.

A description of an illustrative embodiment of the second example described above, in the form of a spinning reel game having 5 reels with 3 presented symbols per reel is provided below. For the purposes of clarity of explanation, in the game all prizes are paid for symbols aligned on the centre line only and no option of providing multiplier bets (i.e. multiple bets per pay line) is provided. Those skilled in the relevant arts will appreciate how to modify the game to accommodate multiple pay lines and multiple bets per outcome.

A player is able to place bets of 1, 2, 3, 4, or 5 credits, where each credit bet purchases some of each reel strip. 5 credits is the maximum purchase of the reel strips, so 5 credits purchases all positions on all the reel strips. The reel strips for credit bets of 1 to 5 credits are shown in Tables 1 to 5 respectively, the inactive symbol positions shown within angle brackets.

TABLE 1

| 1 credit bet | | | | | |
|---|---|---|---|---|---|
| POSITION | REEL 1 | REEL 2 | REEL 3 | REEL 4 | REEL 5 |
| 1 | <A> | A | A | <A> | A |
| 2 | K | Q | K | Q | <K> |
| 3 | <Q> | K | Q | K | Q |
| 4 | A | A | <A> | A | A |
| 5 | <K> | Q | K | Q | K |
| 6 | Q | <K> | <Q> | K | Q |
| 7 | <A> | A | <A> | A | A |
| 8 | K | Q | K | Q | K |
| 9 | <Q> | K | Q | K | <Q> |
| 10 | A | A | A | <A> | A |
| 11 | <K> | Q | K | <Q> | K |
| 12 | Q | <K> | Q | K | Q |

TABLE 2

| 2 credits bet | | | | | |
|---|---|---|---|---|---|
| POSITION | REEL 1 | REEL 2 | REEL 3 | REEL 4 | REEL 5 |
| 1 | A | A | A | A | <A> |
| 2 | K | Q | <K> | Q | K |
| 3 | <Q> | K | Q | K | Q |
| 4 | <A> | A | A | <A> | A |
| 5 | K | Q | K | Q | K |
| 6 | Q | <K> | Q | K | <Q> |
| 7 | A | A | <A> | A | A |
| 8 | <K> | Q | K | Q | K |
| 9 | Q | K | Q | <K> | Q |
| 10 | A | A | A | A | <A> |
| 11 | K | <Q> | K | Q | K |
| 12 | Q | K | Q | K | Q |

TABLE 3

| 3 credits bet | | | | | |
|---|---|---|---|---|---|
| POSITION | REEL 1 | REEL 2 | REEL 3 | REEL 4 | REEL 5 |
| 1 | A | A | A | A | A |
| 2 | K | Q | <K> | Q | <K> |
| 3 | Q | K | Q | K | Q |
| 4 | <A> | A | A | A | A |
| 5 | k | Q | K | Q | K |
| 6 | Q | K | Q | K | <Q> |
| 7 | A | A | A | A | A |
| 8 | <K> | Q | K | Q | K |
| 9 | Q | K | Q | <K> | Q |
| 10 | A | A | A | A | <A> |
| 11 | K | <Q> | K | Q | K |
| 12 | Q | K | Q | K | Q |

TABLE 4

| 4 credits bet | | | | | |
|---|---|---|---|---|---|
| POSITION | REEL 1 | REEL 2 | REEL 3 | REEL 4 | REEL 5 |
| 1 | A | A | A | A | A |
| 2 | K | Q | K | Q | K |
| 3 | Q | K | Q | <K> | Q |
| 4 | A | A | A | A | A |
| 5 | K | Q | K | Q | K |
| 6 | <Q> | K | Q | K | Q |
| 7 | A | A | A | A | A |
| 8 | K | Q | K | <Q> | K |
| 9 | Q | K | Q | K | Q |
| 10 | A | A | A | A | A |
| 11 | K | Q | <K> | Q | K |
| 12 | Q | K | Q | K | Q |

TABLE 5

| 5 credits bet | | | | | |
|---|---|---|---|---|---|
| POSITION | REEL 1 | REEL 2 | REEL 3 | REEL 4 | REEL 5 |
| 1 | A | A | A | A | A |
| 2 | K | Q | K | Q | K |
| 3 | Q | K | Q | K | Q |
| 4 | A | A | A | A | A |
| 5 | K | Q | K | Q | K |
| 6 | Q | K | Q | K | Q |
| 7 | A | A | A | A | A |
| 8 | K | Q | K | Q | K |
| 9 | Q | K | Q | K | Q |
| 10 | A | A | A | A | A |
| 11 | K | Q | K | Q | K |
| 12 | Q | K | Q | K | Q |

As is apparent in the example shown in Tables 1 to 5, the symbols that are rendered inactive are ordinary symbols in the game, as opposed to bonus symbols that trigger a bonus game or other special symbols. Different wagers may result in bonus symbols or other special symbols such as scatter symbols that are provided on the reels becoming active or inactive in addition to the ordinary symbols of the game.

The prize schedule pays only for symbol combinations left to right and the prize schedule is as shown in Table 6.

TABLE 6

| exemplary prize schedule | |
|---|---|
| 5* Aces pays | 250 |
| 4* Aces pays | 100 |
| 3* Aces pays | 15 |

TABLE 6-continued

| exemplary prize schedule | |
|---|---|
| 5* Kings pays | 200 |
| 4* Kings pays | 50 |
| 3* Kings pays | 10 |
| 5* Queens pays | 125 |
| 4* Queens pays | 25 |
| 3* Queens pays | 5 |

The reel strips described with reference to Tables 1 to 5 were designed to provide player returns that are approximately the same regardless of the bet and to ensure that prizes for all symbols are available for each bet. It is anticipated that both of these characteristics may be desirable in some embodiments, although they are not essential for all embodiments. The percentage returns for this example are shown in Table 7.

TABLE 7

| percentage returns | |
|---|---|
| 1 credit bet | 90.471% |
| 2 credits bet | 90.495% |
| 3 credits bet | 90.615% |
| 4 credits bet | 90.856% |
| 5 credits bet | 90.947% |

Referring to Table 1 and Table 6, even though the minimum wager has been made that has the maximum number of inactive symbols, all winning symbol combinations are still possible. This is a result of, for each reel, selectively making some, but not all of any one type of symbol in a class of symbol within which a winning combination can be formed inactive. However, as all positions have not been purchased the chances of winning are reduced. For other styles of games, for example card games for which the presented symbols are all drawn from a common deck, the classes could be defined without reference to the location where the symbol could be presented. However, where the symbols are drawn from different decks for presentation in particular symbol positions, then the classes are defined for each deck.

In alternative embodiments, all the symbols of a class may be made inactive on a reel for certain wager sizes. For example, if the minimum wager is placed, all the "A" symbols may be made inactive in REEL 5, which would mean that the player could not win the prize associated with the spinning up of five "A" symbols (250 according to Table 6) if the minimum wager is placed. The "A" symbols are made active for one or more wager options other than the minimum wager option. In a particular embodiment, a symbol class may be inactive only for the minimum wager and/or the same or a different symbol class may be active only for the maximum wager.

Because the example provided above is a spinning reel game in which the outcomes of the game are defined from left to right across the reels and some of the winning combinations consist of symbols numbering less than the number of reels, then the reels that have the greatest effect on the probability of occurrence of a winning outcome are the leftmost reels. Therefore, by making one third of the symbol position of REEL 1, as in Table 2, then a corresponding one-third reduction in the number of outcomes that can win any of the winning combinations results, but this one-to-one correlation does not result if one third of the symbol positions on REEL 5 is made inactive.

The same relationship occurs for each class of symbols that can form a winning combination. For example, by rendering one third of all 'A' symbols in REEL 1 inactive, the chances of achieving a combination of 3 'A' symbols is reduced by one third.

The game could provide the option to play multiple pay lines, with the player placing a higher wager per game play to purchase the additional pay lines. The active and inactive symbols could remain the same, depending on a separate wager of 1 to 5 credits, which is multiplied by the wager required to play the purchased pay lines to determine the total wager. If multiplier bets (i.e. bets that multiply any prize payable) are available, then these could be added as a factor to determine the total wager required. Combination buttons may be provided on the user interface 107, for example allowing three pay lines to be played, at 1 credit per pay line and with a 5 credit active symbol bet (15 credit wager) using a single button press.

In operation, the inactive symbols may be determined prior to spinning the reels or following the spinning of the reels. If the inactive symbols are determined prior to spinning the reels, then each symbol on a reel is designated as active or inactive and the reel is then spun. Alternatively, the reels could be spun to select which symbols are to be displayed and then the symbols that are to be inactive determined according to a quasi random process, bounded within the required restraints to ensure the correct number of active and inactive symbols are displayed.

If symbols which pay in a scattered position are required in a game, the game designer may select two alternatives. The first alternative is to always make available for all bets all the positions where scatter symbols are located. If this occurs, then scatter prizes are multiplied by total credits bet. The second alternative is to grey out some of the positions where scatter symbols occur, thus reducing the chance of winning scatter prizes. In this case, since the chance of obtaining a winning pattern is varying, the prize for the scatter could be multiplied by only the multiplier bet.

In an alternative embodiment, the game may be a card game, for example a poker style card game. In this embodiment the different wager options would result in a different number of symbols being made inactive. For example, one bet may result in all but one of the Aces in one or more of the decks of cards used in the game to be inactive for forming a winning hand, whereas another bet may result in every Ace in every deck being active.

In another alternative embodiment, a particular wager option may require that half of the symbols on a spinning reel be rendered inactive, and the game controller 101 uses one or more numbers from the RNG 113 to determine which symbols to render inactive. Every symbol may be individually determined as active or inactive according to a 50% probability of each, or alternatively where the inactive symbols are required to form a pattern a single determination could be made as to the location of the pattern in the set of symbols.

An example of random determination is now provided for a spinning reel game with left to right pays, and in which the inactive symbols only appear on reel 1 (the leftmost reel) and the wager options available to the player are 1, 2, or 3 credits. Three positions on the reels are presented for forming three horizontal paylines. There are five distinct symbols on the reel, each of which can form a winning outcome. Each symbol occurs three times on the reel, corresponding to the maximum value wager option relative to the minimum value wager option.

When the player bets 3 credits, all positions on reel 1 are available. When the player bets 1 credit, the game controller 101 uses outputs from the RNG 113 to render inactive symbols in random locations covering two-thirds of all positions. This process may be constrained so that at least one of each of the five distinct symbols remains active on the reel so as to ensure that every winning outcome is still possible in the game. Further constraints may also be introduced depending on the particular implementation. For example in games with long reel strips, a minimum distance between active symbols may be defined to avoid all or an unacceptably disproportionate number the active symbols being clustered on one region of the reel.

Similarly, if the player bets 2 credits, the game controller 101 renders inactive symbols in random locations covering one-third of all positions on the reel.

Therefore, an exemplary five symbols for this example may include the set {A, K, Q, J, 10}. The reel strip may then be this sequence repeated 3 times to form 15 symbol positions as shown in table 8.

TABLE 8

| exemplary reel, random selection | |
|---|---|
| POSITION | REEL 1 |
| 1 | A |
| 2 | K |
| 3* | Q |
| 4* | J |
| 5 | 10 |
| 6* | A |
| 7 | K |
| 8 | Q |
| 9 | J |
| 10* | 10 |
| 11 | A |
| 12* | K |
| 13 | Q |
| 14 | J |
| 15 | 10 |

When 3 credits are paid, all symbol positions are active for forming a winning combination.

When 1 credit is paid, two-thirds of all symbol positions are rendered inactive according to a random process constrained so that at least one of each of the symbols remain. One example is shown in table 8 with the resulting selected active symbol positions indicated in the left column by an asterisk next to the position number.

Alternatively, instead of determining whether each symbol on a reel is active or inactive, the game controller 101 could make a determination for only the symbols that have been already selected to be presented. For example in a spinning reel game that presents 3 symbols from each reel to form outcomes, if in the left most reel two-thirds of the symbols are to be rendered inactive for the wager option that has been placed, then the game controller could randomly select two of the three symbols for rendering inactive. In a second version of this alternative each presented symbol could be independently determined to be inactive with a 66% probability of being rendered inactive, which would result in varying numbers of active symbols for each game play. The second version may be able to be used for a wider range of games with different configurations of paylines. According to this alternative, steps 51 and 52 in FIG. 5 are reversed. This reversal may be made apparent to the a player or may be determined in the background with the player presented with images that appear to show the symbols having been selected as inactive before the stopping position of the reel was determined.

In another alternative embodiment, the game may be a dice game or other game that has multi-dimensional playing elements. In this embodiment different wager options may lead to different faces on a dice being made inactive. The game may be designed so that every winning outcome or at least most winning outcomes are still achievable in the game. The present invention may also have application to poker style card games, in which case certain cards in a deck used in the game or across multiple decks used in the game may be rendered inactive depending on the wager placed. Those skilled in the relevant arts will appreciate that the present invention may have application to still further types of games that currently exist and may be applied games yet to be developed that involve the presentation of symbols to a player to form one or more outcomes that are evaluated for the occurrence of a winning outcome.

While the foregoing description has been provided by way of example of certain embodiments of the present invention as presently contemplated, which utilise gaming apparatus and machines, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A method of providing a wagering game on a gaming machine, the wagering game including a plurality of symbols that are displayed on a display to represent at least one outcome of the game, the plurality of symbols including a plurality of symbol classes, wherein a winning combination in the wagering game is represented as an occurrence of a combination of a plurality of symbols in the same class, the wagering game including a plurality of different winning combinations within two or more of the symbol classes, the method including:

determining which one of a plurality of available wager options has been placed in a game play of the wagering game;

forming at least one outcome from the plurality of symbols by displaying a symbol in each of a plurality of symbol display positions; and awarding an award according to a pay table of the gaming machine if a winning combination occurs;

wherein the method further includes, for at least one wager option, defining at least one, but less than all of the symbols in at least two different symbol classes as inactive for forming a winning combination.

2. The method of claim 1, wherein at least one said winning combination is available for each and every one of the plurality of symbol classes irrespective of the wager option that is placed.

3. The method of claim 2, wherein for at least one wager option, the symbols that are rendered inactive have the effect of approximately at least one third of the symbols being defined as inactive for forming a said winning combination.

4. The method of claim 1, wherein for at least one of the wager options all or substantially all of the symbol classes have at least one symbol that is defined as inactive for forming a said winning combination.

5. The method of claim 1, wherein the wagering game is a spinning reel game having a plurality of reels, each reel having a plurality of symbols that are each located in a symbol position on the reel, wherein forming at least one outcome includes determining the stopping position of the reels to display symbols on the reels in the symbol display positions, and wherein on at least one of the reels symbols from at least two different symbol classes are defined as inactive.

6. The method of claim 5, wherein a plurality of said winning combinations are defined from left to right across the spinning reels and of those winning combinations at least one consists of r symbols, wherein r is less than the number of spinning reels, and for at least one of the wager options, between one third and one half of the symbol positions on a reel within the r leftmost reels are rendered inactive.

* * * * *